United States Patent [19]

Echols et al.

[11] Patent Number: 4,624,310

[45] Date of Patent: Nov. 25, 1986

[54] WELL APPARATUS

[75] Inventors: Ralph H. Echols, Carrollton; Bhanubhai H. Patel, Grand Prairie, both of Tex.; James B. Renfroe, Jr., Valencia, Calif.

[73] Assignee: Otis Engineering Corporation, Carrollton, Tex.

[21] Appl. No.: 736,232

[22] Filed: May 20, 1985

[51] Int. Cl.[4] ..... E21B 43/12; E21B 34/10

[52] U.S. Cl. ..... 166/106; 166/105.5; 166/188; 166/317; 166/321

[58] Field of Search ..... 166/106, 105.5, 105, 166/317, 319–321, 323, 325, 332, 151, 149, 148, 188, 133

[56] References Cited

U.S. PATENT DOCUMENTS

| | | | |
|---|---|---|---|
| 3,448,803 | 6/1969 | Sizer | 166/115 |
| 3,638,732 | 2/1972 | Huntzinger et al. | 166/65.1 |
| 3,799,268 | 3/1974 | Cochran | 166/313 |
| 3,823,778 | 7/1974 | Mott | 166/313 |
| 3,897,822 | 8/1975 | Mott | 166/321 |
| 4,044,829 | 8/1977 | Jessup et al. | 166/264 |
| 4,441,558 | 4/1984 | Welch et al. | 166/317 |
| 4,448,254 | 5/1984 | Barrington | 166/373 |
| 4,461,353 | 7/1984 | Vinzant et al. | 166/322 |
| 4,502,536 | 3/1985 | Setterberg, Jr. | 166/105.5 |

*Primary Examiner*—James A. Leppink
*Assistant Examiner*—Hoang C. Dang
*Attorney, Agent, or Firm*—Vinson & Elkins

[57] ABSTRACT

A well system employs a pump to lift liquid through a primary tubing and subsurface safety valve. The tubing passes through a packer and a vent valve vents gas from the well through the packer. The power transfer means may extend through the vent valve and the vent valve may also control a cross-over in the packer for recirculation of liquid to the pump when the well is shut-in. The vent valve has associated therewith a kill valve permitting pumping of kill fluid into the well. The vent remains closed in the presence of ambient pressure up to a selected value and above this value the kill valve opens thus permitting testing of the packer with annulus pressure below the selected pressure and pump through to kill the well with pressure above the selected pressure.

11 Claims, 10 Drawing Figures

WELL APPARATUS

This invention relates to well apparatus and more particularly to a combination packer, vent valve and kill valve particularly designed for use with a well pumping system.

Vent valves for use with pumps are well known (see Setterberg U.S. Pat. No. 4,502,536.

It is desirable to be able to test the packer with which the vent valve is associated after it is run. It is further desirable to at any time be able to pump kill fluid down the well and through the vent valve passageway to kill the well. There has not been available in the past an apparatus providing for venting of gas above a pump which would permit testing of the packer and would permit pumping of kill fluid down through the vent valve passageway in response to control of pressure within the well annulus.

This invention provides an apparatus for use with a pump in which gas may be vented through a vent valve which will remain closed in the presence of ambient pressure up to a selected value in combination with or having as a part thereof a kill valve which will open when ambient pressure exceeds the selected value. This permits testing of the packer by pressuring up the annulas below the selected value, and pumping kill fluid through the packer by pressuring up the annulus to a pressure above the selected value. In one preferred form the valve may be reset into closed position if control line pressure is available after killing well; thus alleviating need to pull completion to redress valve. The valve can be reset in this manner as many times as desired.

It is an object of this invention to provide an apparatus including a well packer with vent valve and kill valve in which the kill valve is normally closed and the vent valve is controlled by control pressure from the surface and in which the vent valve remains closed in the presence of ambient or annulus pressure up to a selected value and in which a kill valve associated with or forming a part of the vent valve opens in response to ambient pressure above said selected pressure to permit pumping of kill fluid through the packer.

Another object is to provide an apparatus as in the preceding object in which the vent and kill valves are in communication with the same flow way through the packer.

Another object is to provide a combination vent and kill valve having a valve member and seat with the valve member controlled by control fluid pressure, in which one of the valve member and seat is releasably held in closed position in the absence of control fluid pressure and in the presence of ambient pressure up to a selected value and in which the release means permits movement of the valve member or seat to open position when subjected to an ambient pressure in excess of the selected pressure.

Another object is to provide a combination vent and kill valve which may be reset to closed position after killing a well.

Another object is to provide the apparatus as in the preceding object in which the release means is provided by a shear means or in the alternative by a collect or the like.

It is a further object to provide a vent valve and kill valve as in the preceding objects in which the valve is associated with a cross-flow passage in a packer and a check valve in the cross-flow passage is held in seated position when the vent valve is in its normal open venting position.

Other objects, features and advantages of this invention will be apparent from the drawings, the specification and the claims.

In the drawings wherein illustrative embodiments of the invention are shown and wherein like reference numerals indicate like parts:

Figure 1:
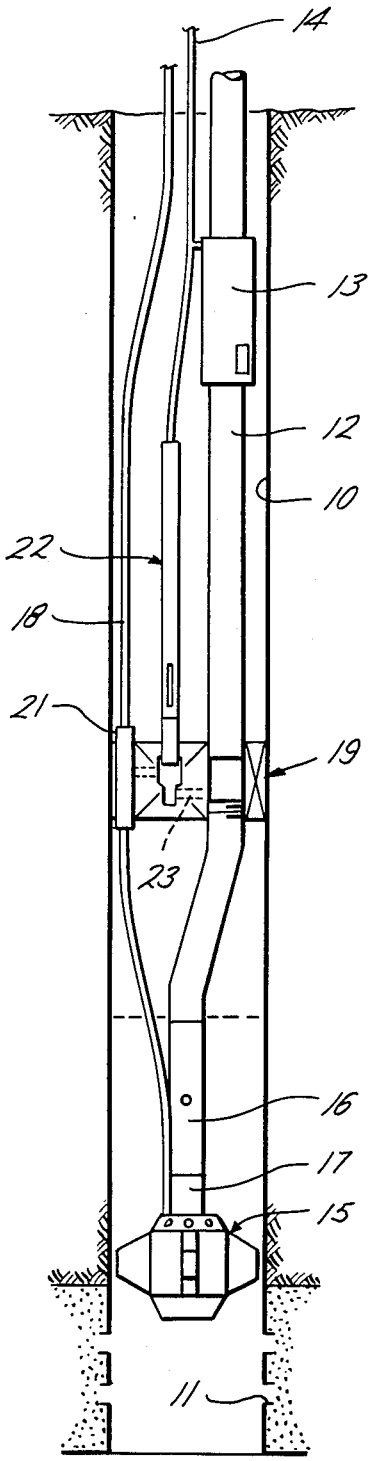
FIG. 1 is a schematic illustration of apparatus in accordance with this invention associated with a pump in a well.

In FIG. 1 there is shown one preferred system constructed in accordance with this invention. The well is cased at 10 and produces through the perforations 11.

A tubing 12 extends from the surface down to the area of the perforations 11. The tubing includes a conventional subsurface safety valve 13 which is controlled from the surface by pressure within the control pressure conduit 14 in the conventional manner.

At the lower end of the tubing a pump indicated generally at 15 is utilized to lift liquids from the formation to the surface. Immediately above the pump there may be provided a side door valve 16 and a standing valve 17. The standing valve 17 prevents reverse flow through the tubing and the side door valve 16 is normally run open to facilitate landing of the system and closed prior to placing the well on production.

A power transfer conduit 18 extends from the surface to the pump 15. For instance, the pump 15 may be an electric pump and the power transfer 18 would be an electrical conduit.

A packer indicated generally at 19 is positioned adjacent the pump 15 and the tubing 12 as well as the power conduit 18 extend therethrough. As will be understood by those skilled in the art the tubing is sealingly engaged to the packer and the conduit 18 is sealingly secured to the upper end of a pup joint 21 which extends upwardly from the packer. This pup joint is open at its lower end and provides a part of the vent passageway extending through the packer.

As shown in said Setterberg patent, there is a cross-over 23 in the packer to interconnect the tubing 12 and the pup joint 21 with each other and with the vent valve indicated generally at 22. This cross-over passage is shown in dashed lines at 23. As shown in the Setterberg patent and hereinafter, when the vent valve is open, the cross-over 23 between the vent valve and the tubing 12 is closed so that gas under the packer vents into the casing annulus above the packer while liquid from the well is produced through the tubing. Thus, the two passageways through the packer, that is the flow way provided by the tubing 10 and the flow way provided by the pup joint 21 and cross-over passage are connected to the vent valve.

One of these flow ways is controlled by the vent valve 22 which has a valve member movable between open and closed positions in response to control pressure in the control line 14.

The vent valve is designed to remain closed when not subjected to a control pressure and when subjected to ambient pressure, that is pressure within the casing tubing annulus below a selected value such as for instance, 800 to 1,000 psi. This permits the packer to be set and tested by pressure up to the selected value in the conventional manner.

There is a kill valve associated with the packer and vent valve. As will be shown hereinafter the kill valve may preferably form a part of the vent valve although it might control a third passageway through the packer if desired. The kill valve is designed to remain closed when subjected to ambient pressure up to the selected pressure. Above the selected pressure the kill valve opens thus permitting kill fluid to be pumped into the well to kill the well if desired. The valve can be reset into closed position after killing the well by control fluid pressure.

Figure 2:
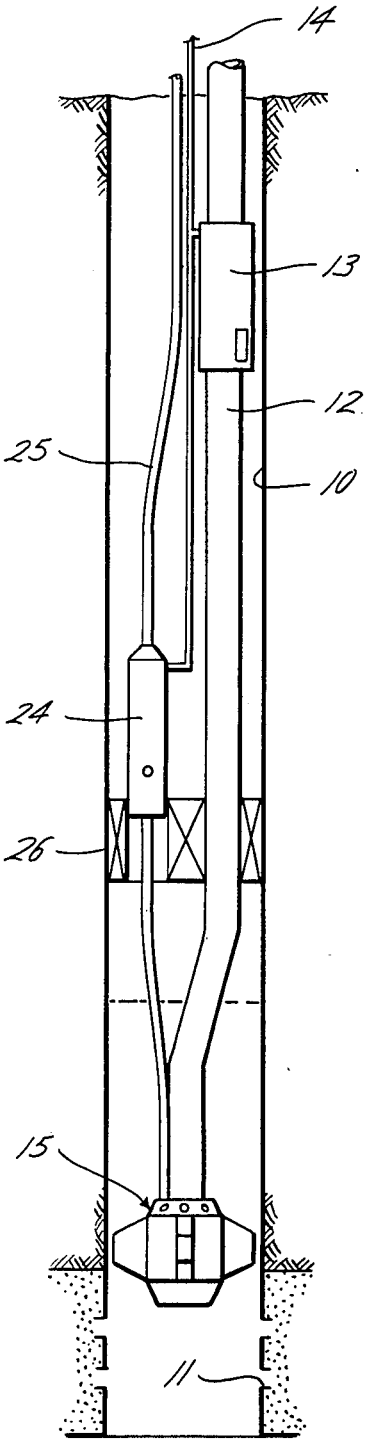
FIG. 2 is a schematic illustration similar to FIG. 1 of another of this invention.

FIG. 2 shows another preferred embodiment of the invention. Again the well is cased at 10, produces through perforations 11 and has the production tubing 12 therein. The subsurface safety valve 13 is controlled by pressure in the control conduit 14.

In this form of the invention the vent valve 24 also provides a kill valve and is so designed that the power conduit 25 is sealed to the upper end of the valve 24 and extends therethrough. While this form of the invention might include the cross-over passageway 23 as shown in FIG. 1, it is omitted in the FIG. 2 form as in some instances it is not desirable to have the cross-over passage 23 which as taught in the Setterberg patent provides for recirculation of the liquid well fluid when the well is shut-in. Thus, the packer 26 is simpler in form as shown. This installation omits the standing valve 17 and side door valve 16 to illustrate that they are not necessary to the installations but they may be employed in either system if desired.

Figure 4:
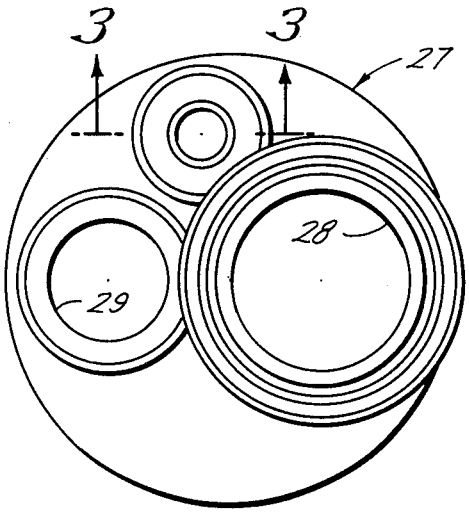
FIG. 4 is a top-plan view of the packer and associated tubing, power cable passageway and vent valve shown schematically in FIG. 1.
Figure 5:
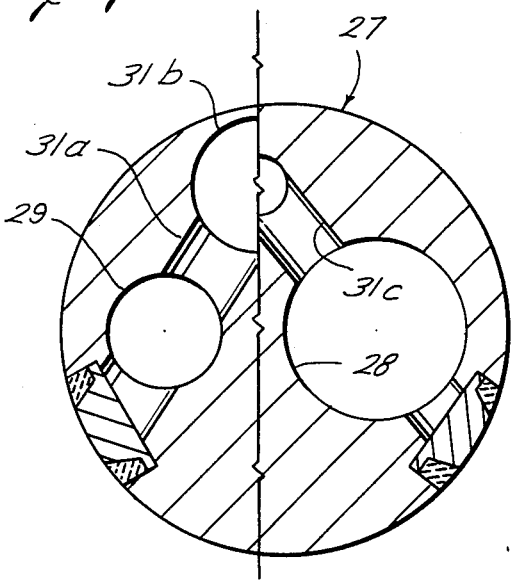
FIG. 5 is a view along the lines 5—5 of FIG. 3C.

A packer indicated generally at 27 (FIGS. 4 and 5) is designed for use particularly in the FIG. 1 form of the invention. The packer includes the bore 28 for fluid communication with tubing 12 to transmit the liquid produced by the well to the surface. The bore 29 provides the passageway through which the power cable 18 (not shown in FIG. 5) extends and with the cross-over passage 31*a* and 31*b* a vent flow way is provided through the packer.

As illustrated in said Setterberg patent, the packer also has a cross-over passageway 31*c* which communicates with the cross over passage 31*a* as well as the passageway 31*b* and vent passage 29.

Figure 3A:
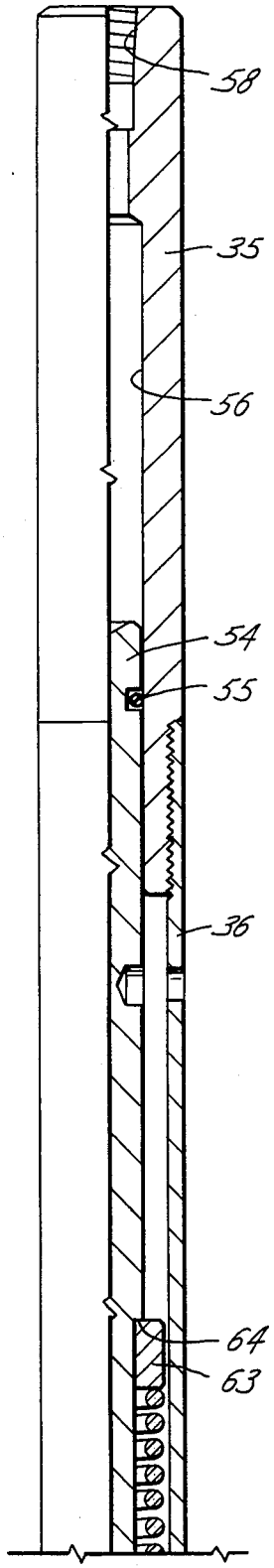
FIGS. 3A, 3B and 3C are continuation views of a combination vent and kill valve in closed position taken along the lines 3—3 of FIG. 4 for use in the apparatus shown in FIG. 1.
Figure 6:
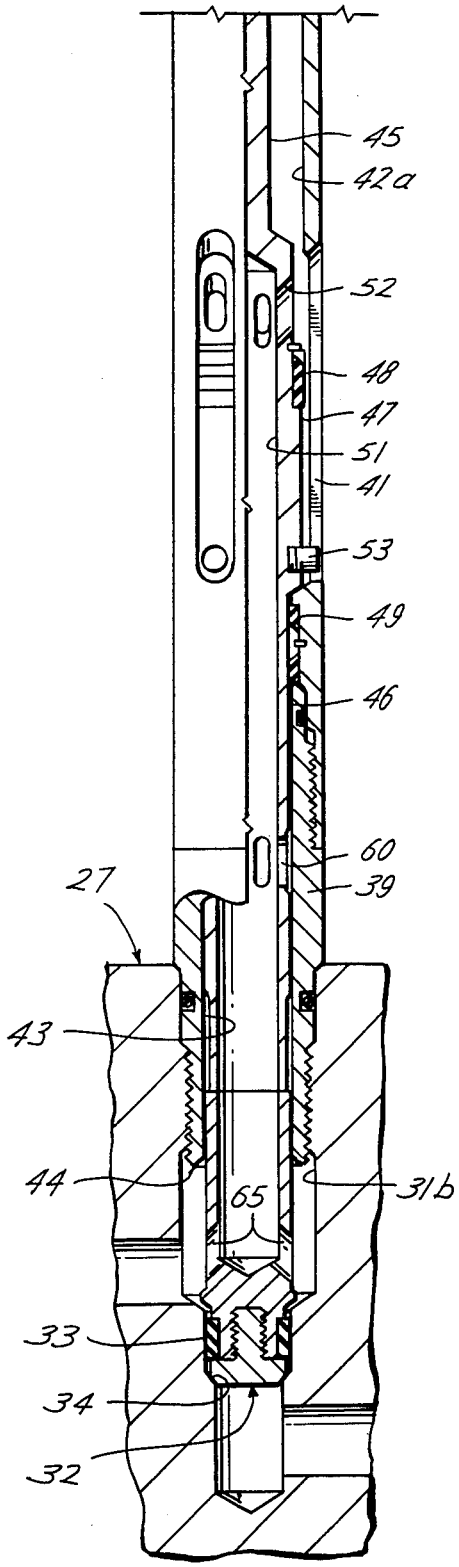
FIG. 6 is a view similar to FIG. 3C showing the vent valve in venting position.

Preferably, a check valve 32 is provided in the cross over passageway 31*a*–31*c* which prevents flow of vent gas from the vent passageway to the production passageway 28. On the other hand, when the check valve is unseated, circulation is permitted between the production passageway 28 and the vent passageway 29 providing for recirculation of liquid from the pump. As explained in Setterberg, this occurs when the well is shut in and the vent valve is closed. While any form of check valve could be utilized in the illustrated embodiment the check valve 32 includes a cylindrical element 33 which cooperates with a bore 34 in the passageway 31*b* to prevent reverse flow when the check valve is seated as illustrated in FIG. 6. With the check valve unseated as shown in FIG. 3*c*, circulation is permitted through the packer to recirculate liquid to the pump 15.

Figure 3B:
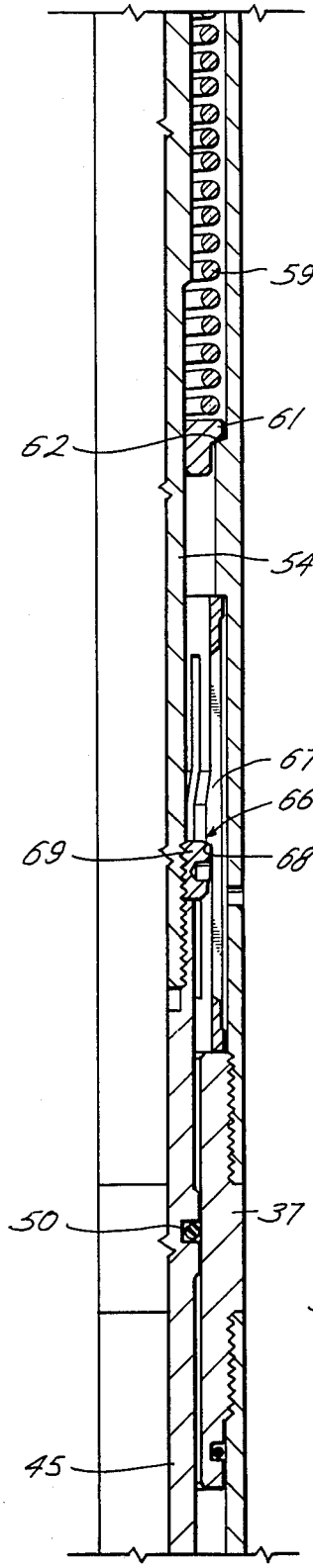
Figure 3C:
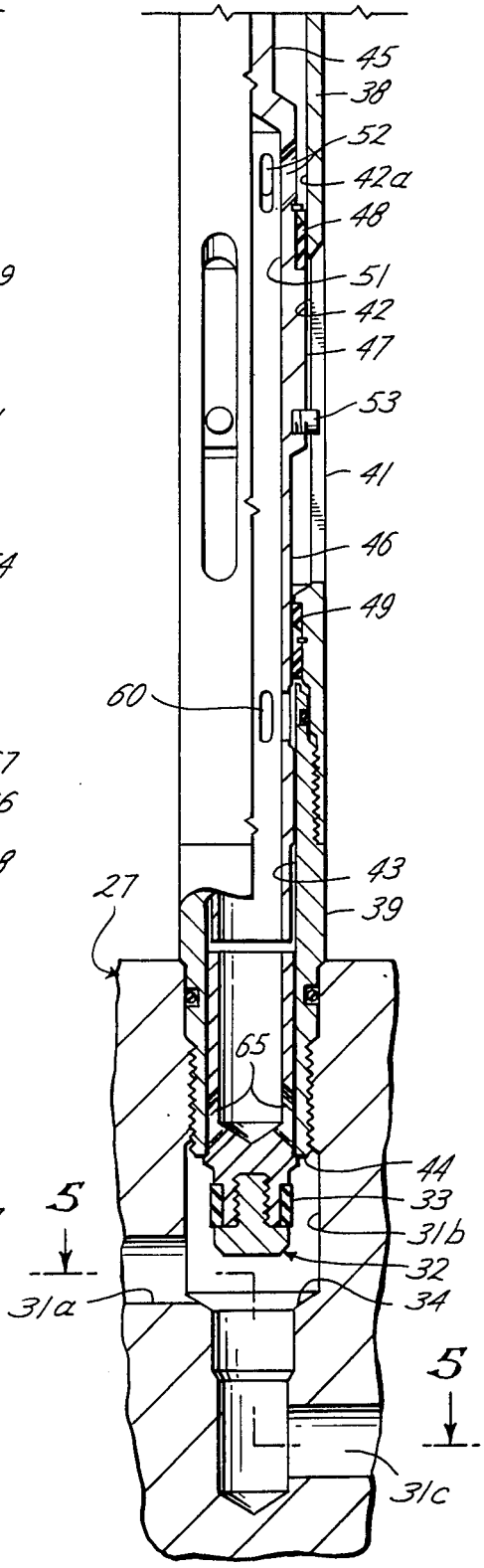

FIGS. 3 and 6 illustrate a preferred form of vent and kill valve particularly designed for use with the FIG. 1 form of the invention. This valve could also be used in the FIG. 2 form of the invention by providing for separate passage of the power conduit 18 through the packer.

The housing includes a top sub 35, a spring housing 36, a connector 37, a ported housing 38 and a lower sub 39.

The housing has a flow way therethrough including the ports 41 in the period housing, a bore 42 in the ported housing, and a bore 43 in the lower sub which communicates with the lower end 44 of the lower sub 39.

A sleeve valve means and a cooperative seat means control flow through this flow way. The sleeve valve means is provided by the valve member 45 having a first relatively smaller outer diameter section 46 and a second relatively larger outer diameter section 47. The larger diameter section 47 carries the sliding seal means 48 which slidingly and sealingly cooperates with surface 42*a* of the bore through the ported housing. The lower sub 39 carries the seal 49 with which the smaller diameter section 46 of the valve member cooperates to provide a sliding seal. With the valve member in the position shown in FIG. 3*c*, the upper seal 48 is in engagement with the wall 42*a* of the ported housing and the seal 49 engages the outer diameter section 46 of the valve member. As the valve member is imperforate between these two seals, when in the position shown in FIG. 3C, the vent valve is closed as an O-ring 50 carried by the valve member sealing engages connector 37 to confine fluid below the 0-ring. When the vent valve member is moved downwardly, as shown in FIG. 6, a bore 51 in the vent valve member which extends from its lower extremity to a plurality of ports 52 provides for flow through the valve member to permit vent gas to flow through the vent valve. A plurality of pins 53 are carried by the valve member and slide within the ports 41 to prevent rotation of the valve member.

A suitable pressure responsive member such as a piston, controls movement of the valve member between open and closed positions in response to control fluid in conduit 14. This pressure responsive member may be provided by a piston 54 having a sliding seal 55 thereon which reciprocates within the dome 56. The control fluid conduit 14 is secured to the threaded upper end 58 of the top sub to provide control fluid pressure in the dome for reciprocating the piston 54.

Resilient means provided by spring 59 is supported on ring 61 which is in turn supported on a shoulder 62 in the spring housing. The force of the spring is exerted on the valve member through a ring 63 bearing against shoulder 64 on the piston 54. Thus, in the absence of control fluid pressure, the spring 59 moves the valve member to the up position shown in FIG. 3 to close the vent valve. Application of control fluid pressure through line 14 to piston 54 moves the valve down against the action of spring 59 to the position shown in FIG. 6 to move the vent valve to open position. If desired, the height of the check valve 32 may be such that it is always slidable within the bore 43 of the lower sub and is positively moved to closed position as shown in FIG. 6 by engagement with the lower end of the valve member 45.

While the vent and kill valves might be separate valves, they are preferably provided in one structure such as shown in FIGS. 3 and 6. To provide the kill valve, the seals 49 and 48 provide a pressure responsive member which is subject to ambient pressure, that is the pressure within the casing tubing annulus and the valve member is movable upwardly from the closed position shown in FIG. 3C in response to ambient pressure acting on this area. When the valve member moves upwardly, the series of ports 60 in the valve member move to a position above the seal 49 and are exposed to the slotted ports 41 which cooperate with bore 51 in the valve member 45 to provide a flow way through the combination vent and kill valve. When a well is being killed by pumping fluid into the annulus, flow is in a downward direction which will hold the check valve 32 on its seat. To insure a large flow area through the packer, the check valve 32 is provided with ports 65 so that kill fluid may readily pass into the cross over passage 31*a* and thence down through the vent flow way 29. It will be apparent also that when the valve is in vent condition these ports provide for flow of vent gas.

Preferably, the ports 60 provide a large flow area for kill fluid to be pumped into the well. As the vent ports 52 are designed to convey gas, they may be smaller but desirably they are also of large size to readily pass accoustical waves down through the valve when in the open position shown in FIG. 6 to determine the liquid level in the well as will be understood by those skilled in the art. Accoustical soundings, of course, cannot be made through the tubing 12. Provision is preferably made for kill fluid to be pumped through the vent valve as both the standing valve 17 and the construction of most pumps prevent rapid flow of fluid down through the tubing. Also, kill fluid is desirably placed on top of the well fluids and away from the producing formation to minimize damage to the producing formation.

Desirably, after the packer is set and before the well is placed on production, the packer is tested. For this purpose, the kill valve is rendered inoperative by release means up to a selected pressure which may be 800–1,000 psi by way of example. This release means maintains the valve member and seat in closed position with no control fluid pressure present and with ambient pressure up to the selected value. Control pressure would not normally be present during testing of the packer. If it is desired for ambient test pressure to exceed selected release pressure, then control pressure can be used to augment release means and prevent kill valve from releasing.

This release means permits movement of either of the valve member or the seat in response to ambient pressure in excess of the selected pressure to open the valve. In the form of valve shown in FIGS. 3 and 6, the valve member is held by a releasable means provided by a collet indicated generally at 66. The collet sleeve 67 has a downwardly facing shoulder 68 which is engaged by the nut 69 carried on the piston 54. In the normal operation of the vent valve the spring 59 is not capable of overcoming the collet and when control fluid pressure is removed, the nut 69 moves up and engages shoulder 68 to limit further upward movement of the vent valve and cause the valve to assume the position shown in FIGS. 3A, B and C. The collet sleeve 67 is designed to release nut 69 and valve member 45 when a force exerted over the area of the pressure responsive member provided by the seals 48, 49, 50 and 55 reaches a selected value such as 800–1,000 psi. This force exceeds the strength of the collet sleeve 67 and the sleeve expands to permit the nut 69 to pass the shoulder 68 thus moving the valve member to full up position to bring the ports 41 and 60 into engagement to permit kill fluid to be pumped into the well. Seals 49, 48 and 50 provide net area of zero when exposed to pressure from ambient (annulus) pressure or gas pressure in 31*a* (cross passageway). Thus, the net area of the pressure responsive member is equal to area of seal 55 when exposed to annulus pressure. Thus, when the system is landed and the packer set, ambient pressure in the casing annulus may be exerted up to a selected pressure to test the packer. Thereafter the vent valve is operated in the normal manner to vent gas while the pump 15 is operating and to close and permit the check valve to leave its seat and liquid to circulate through the packer crossover when the well is shut in and the pump is running to prevent damage to the pump. Thereafter, if at any time it becomes desirable to kill the well, kill fluid may be pumped into the casing annulus and forced at a pressure in excess of the selected value against the pressure responsive member of the kill valve to move it to open position and permit kill fluid to be pumped into the well. The valve may be re-cocked into closed position by pressuring up control pressure against piston 54 to move nut 69 past shoulder 68. Other forms of release means, such as shear pins between the valve member and piston might also be utilized to releasably hold the valve member in normal operating position while the vent valve is in use and then release the valve to permit it to move to the kill valve open position as will be illustrated in conjunction with the other preferred form of combination vent and kill valve.

Figure 7A:
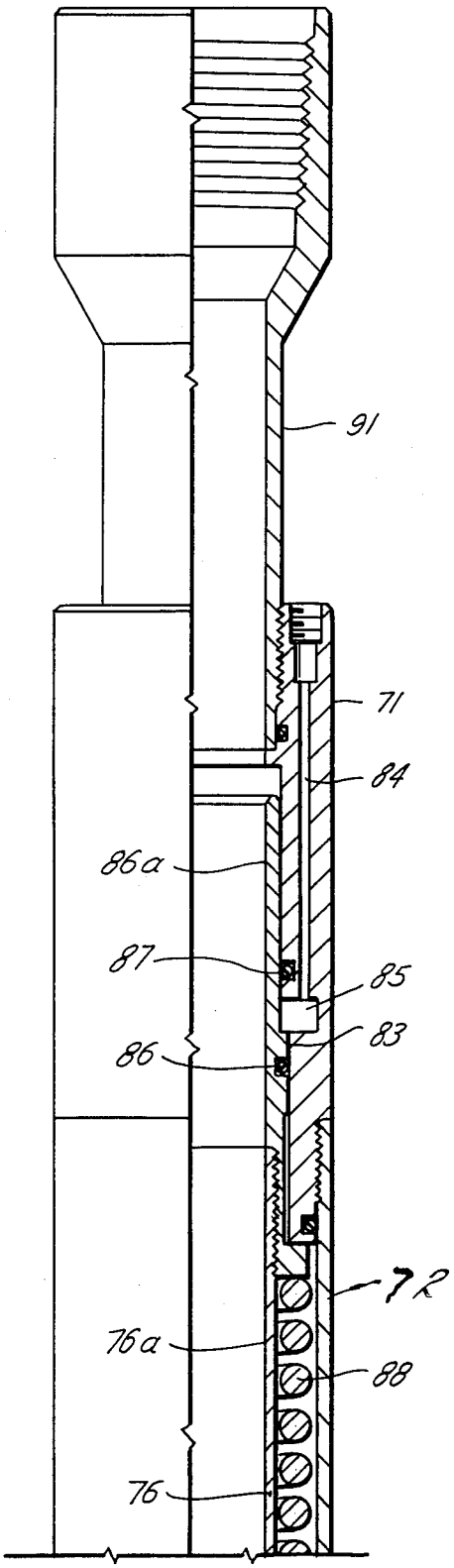
FIGS. 7A and 7B are continuation views of another form of combination vent and kill valve specially designed to be used in the schematic illustration of FIG. 2.
Figure 7B:
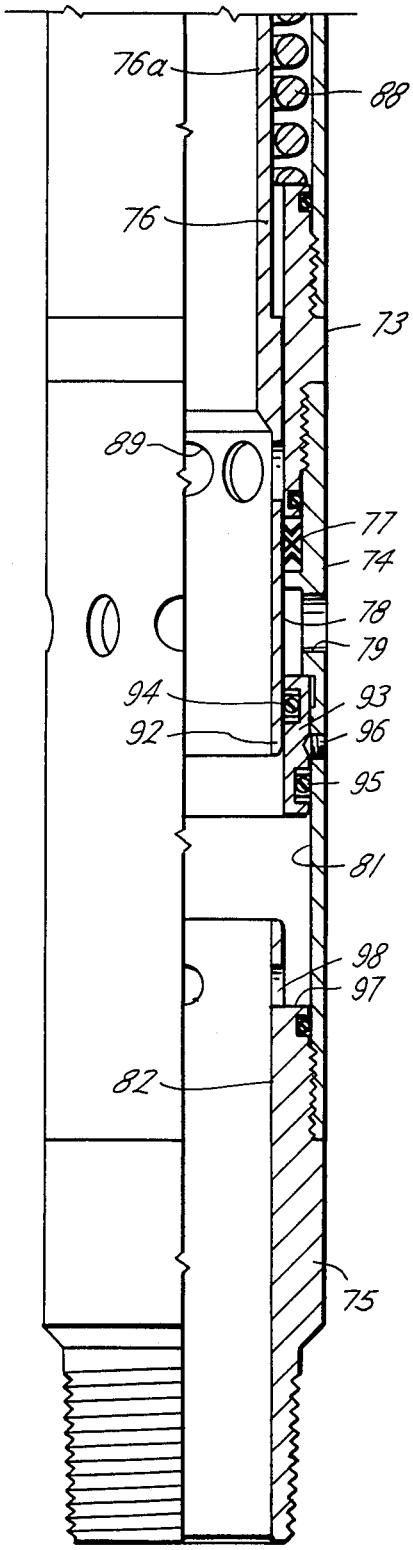

In FIGS. 7A and 7B there is shown an alternate form of combination vent and kill valve which is particularly adapted for use with the FIG. 2 form of this invention. In this valve the housing is provided by upper sub 71, spring housing 72, connector 73, ported housing 74 and lower sub 75.

A valve means is provided by valve member 76 cooperable with the valve seat provided by seal 77 held between the connector 73 and ported housing 74 which cooperates with the outer diameter section 78 of the valve member to control flow through the flow way provided by ports 79 in the ported housing 74, the bore 81 in the ported housing and the bore 82 in the lower sub 75.

A piston 83 is secured to the valve member 76 and is exposed to control pressure in passageway 84 and chamber 85. The piston carries the sliding seal 86 and the upper sub 71 carries the seal member 87 to confine pressure in the chamber 85. As the seal 86 has a larger diameter than the seal 87, a pressure responsive member is provided against which control pressure can act to reciprocate the piston 83 against the force of the spring 88 which provides the resilient means urging the valve toward closed position as shown in FIG. 7.

The valve member is provided with a plurality of ports 89 which, when the valve member is moved downwardly register with the ports 79 in the ported housing to provide for flow through the flow way in the valve. As the several portions of the housing are sealed together by suitable seals, the fluid within the flow way is contained while the valve is in the upper closed position shown in FIG. 7.

Extending from the upper end of the valve housing is a suitable connector sub 91 which is adapted to sealingly receive a connector, not shown, carried by the power cable 18 and the power cable extends through the open bore 86*a* in the piston and 76*a* in the valve member as well as the open bore 82 in the lower sub. In this manner, the cable 18 is sealingly secured and extends through the valve member and down through the packer 19 as shown in FIG. 1 thus eliminating the need for a third passageway through the packer in this type of design.

A kill valve is provided by the lower end 92 of the valve member cooperating with a kill valve seat 93 in the ported housing 74. This seat has an internal O-ring seal 94 which cooperates with the outer diameter portion 78 of the valve member to seal therebetween. The seat also has an external O-ring seal 95 which seals between the seat and ported housing 74.

The seat is pinned in place by one or more shear pins 96. These shear pins are selected to shear upon the selected force such as 800–1,000 psi being applied to the pressure responsive area defined by the seals 94 and 95 in their engagement with the surfaces 78 and 81.

Thus, when pressure in the casing annulus which is referred to hereinabove as ambient pressure, is applied at a value less than the selected value, the valve, in the absence of control pressure, remains closed and the packer 26 may be tested.

In the event it is desired to kill the well, pressure in the casing annulus is raised to a value above the selected value to shear the shear pins 96 and this pressure drives the seat 93 downwardly to disengage the seat from the valve member 76 and permit kill fluid to be pumped down through the passageway into the well below the packer. The seat 93 may move downwardly to rest upon the upper end 97 of the lower sub 75. If in any way the outlet provided by the upper end of the lower sub becomes obstructed, the lateral ports 98 will provide for passage of kill fluid through the passageway.

As the two seals 77 and 94 seal against the same common diameter surface 78, it is apparent that ambient pressure does not affect the operation of the valve member 76 and thus may be applied below the selected pressure to tester packer 26.

From the above it will be seen that there has been provided an apparatus comprising a well packer having associated therewith a kill valve and a vent valve and preferably a combination kill and vent valve which permits the testing of the packer and permits introduction of kill fluid into the well through the kill valve. Either of the valves may be associated with a cross flow passageway such as shown in conjunction with FIG. 3 to control recirculation. In FIG. 3 a provision is made for positively holding the check valve controlling this passageway in seated position while the vent valve is open. If a cross flow passageway be provided in the FIG. 2 form of the invention, the valve member 76 could be provided with a lower extension or tailpipe in the manner taught in FIG. 3 to maintain the check valve 32 of FIG. 3C in seated position while the vent valve is in vent position.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. Apparatus comprising:

a well packer having at least two flow ways therethrough, a conduit providing a first control pressure, vent valve means connected to said conduit and controlling one of said flow ways and having a flow member reciprocal in both directions between open and closed positions for multiple cycles in response to a first control pressure in said conduit, said vent valve means remaining closed in the absence of first control pressure and when subjected to a second ambient pressure less than a selected value, and kill valve means associated with said packer and vent valve and in combination with one of said flow ways, said kill valve means opening in response to a second ambient pressure above said selected value.

2. The apparatus of claim 1 wherein said vent and kill valve means are in communication with the same flow way.

3. A combination vent and kill valve comprising;

a housing having a flow way therethrough, a valve member and valve seat in said housing controlling flow through said flow way, a ported fluid chamber including a piston controlling reciprocal movement of said valve member between open and closed positions for multiple cycles in response to a first control fluid pressure in said port, and release means maintaining said valve member and seat in closed position in the absence of first control fluid pressure and when subjected to a second ambient pressure up to a selected value, a pressure responsive means on one of said valve member and seat, said release means permitting movement of one of said valve member and seat to a position opening the valve in response to a second ambient pressure on said pressure responsive means in excess of said selected pressure.

4. A combination vent and kill valve comprising:

a housing having a flow way therethrough, a valve member and valve seat in said housing controlling flow through said flow way, a ported fluid chamber including a piston controlling reciprocation of said valve member in both directions between open and closed positions for multiple cycles in response to a first control fluid pressure, one of said valve member and seat having a pressure responsive member exposed to a second ambient pressure, and shear means holding one of said valve member and seat in engagement with the other of said valve member and seat, said shear means releasing said one of said valve member and seat to move to a position opening said valve in response to a second ambient pressure exceeding a selected value.

5. The combination vent and kill valve of claim 4 wherein said valve seat is releasably secured to said housing by said shear means.

6. The combination vent and kill valve of claim 3 or 4 wherein said piston and valve member are provided by a sleeve, and power transfer means is secured to the upper end of the valve and extends through said sleeve.

7. A combination vent and kill valve comprising;

a housing having a flow way therethrough, a valve member and valve seat in said housing controlling flow through said flow way, a ported fluid chamber including a piston controlling reciprocal movement of said valve member between open and closed positions for multiple cycles in response to a first control fluid pressure, one of said valve member and seat having a pressure responsive member exposed to a second ambient pressure, and collet means holding said one of said valve member and seat in closed position in the absence of first control pressure and when subjected to second ambient pressure up to a selected value, said collet means permitting movement of said one of said valve member and seat to a position opening said valve in response to second ambient pressure exceeding said selected value.

8. A combination vent and kill valve comprising;

a housing having a flow way therethrough, a sleeve valve member and cooperative seat means controlling flow through said flow way, a piston carried by said valve member and moving said valve member to one open position in response to control fluid pressure, resilient means moving said valve member to closed position in the absence of control fluid pressure, collet means between said sleeve valve member and housing releasably limiting movement of said valve member by said resilient means, and pressure responsive means on said valve member responsive to ambient pressure above a selected value for overcoming said collet and cooperating with said resilient means to move said sleeve valve member to a second open position.

9. The combination vent and kill valve of claim 3, 4, 5, 7, or 8 wherein the valve is mounted in a packer having a production and a vent flow way therethrough, a cross passageway connecting said two flow ways, and a check valve in said cross passageway;

said valve member having a tailpipe engaging said check valve and holding it in closed position when said valve member is in open position in response to control fluid pressure.

10. The combination vent and kill valve of claim 8 wherein after said sleeve valve member has been moved to a second open position, control pressure on said piston returns said sleeve valve member to said one open position.

11. A pump system comprising, a packer having dual passageways, a tubing extending through one of said passageways, a subsurface safety valve controlling flow through said tubing, a vent valve controlling flow through the other of said passageways, said vent valve having a tubular body and sleeve valve member and cooperable seat to control flow through the vent valve, a pressure-responsive member connected to said valve member to control reciprocation of said valve member, a connector sub at the upper end of said body, and a power cable extending through said body and sleeve valve member and sealed to said connector sub.

* * * * *